United States Patent [19]

Tokushima et al.

[11] Patent Number: 4,469,531

[45] Date of Patent: Sep. 4, 1984

[54] SYSTEM FOR PHOSPHATING OF OBJECTS TO BE TREATED

[75] Inventors: Yasuo Tokushima; Yoshinobu Takahashi; Kenji Fukuta, all of Toyota, Japan

[73] Assignee: Toyota Jidosha Kabushiki Kaisha, Toyota, Japan

[21] Appl. No.: 455,851

[22] Filed: Jan. 5, 1983

Related U.S. Application Data

[63] Continuation-in-part of Ser. No. 282,002, Jul. 10, 1981, abandoned.

[30] Foreign Application Priority Data

Sep. 1, 1980 [JP] Japan ..... 55-123084[U]

[51] Int. Cl.[3] ..... C23F 7/10

[52] U.S. Cl. ..... 148/6.15 R; 118/423; 118/429

[58] Field of Search ..... 148/6.15 R; 118/429, 118/423

[56] References Cited

U.S. PATENT DOCUMENTS 4,196,023 4/1980 Rowe ..... 148/6.15 R 4,287,004 9/1981 Murakami ..... 148/6.15 R

*Primary Examiner*—Sam Silverberg

*Attorney, Agent, or Firm*—Oblon, Fisher, Spivak, McClelland & Maier

[57] ABSTRACT

A system for phosphating objects, such as automobile bodies, having bottom portions of complicated configuration, the system including a tank for holding a phosphating liquid, a mechanism for generating recirculation of the fluid in the tank, a conveyor mechanism for continuously conveying the objects from an inlet side to an outlet side in such a manner that the objects are fully dipped into the fluid, the tank having a sloped bottom in the inlet side and the conveyor mechanism having the same inclination of that of the sloped bottom of the tank, a gush-type spraying nozzle mechanism arranged on the sloped bottom portion of the tank and connected to the recirculation mechanism for generating a flow of fluid from the sloped bottom of the tank towards the bottom portions of each object conveyed, the direction of the flow being inclined rearwardly with respect to a vertical line in the direction of movement of the objects by the conveyor mechanism at an inlet side portion thereof and also inclined upwardly with respect to the surface of the sloped bottom of the tank.

6 Claims, 7 Drawing Figures

SYSTEM FOR PHOSPHATING OF OBJECTS TO BE TREATED

This is a continuation-in-part application of U.S. application Ser. No. 282,002, filed July 10, 1981, now abandoned.

FIELD OF THE INVENTION

The present invention relates to treating, and more particularly to a system for phosphating objects to be treated, said system being of a dipping type wherein the objects are fully dipped into a phosphating liquid.

BACKGROUND OF THE INVENTION

In a dipping type phosphating system, an object to be treated is introduced into a bath containing a phosphating liquid, so that the object is fully dipped into the fluid. In such a system, the formation of a film layer of the phosphate crystals on the surface of the object after the treatment is mainly determined by a chemical reaction between the object and the liquid which takes place in a time period, for instance, as short as 0.5–30 sec. from the beginning of the dipping of the object in the liquid. However, when the object has a complicated configuration, the liquid does not uniformly reach all portions in such a short time period, so that air-pockets are apt to be generated. Such air-pockets adversely affect the corrosion resistibility during use.

SUMMARY OF THE INVENTION

An object of the present invention is to provide a system capable of providing a film layer of phosphate crystals on portions of an object having a complicated configuration.

According to one aspect of the present invention a system for phosphating objects, such as automobile bodies, having bottom portions of complicated configurations is provided, said system comprising:

a tank for holding a fluid of phosphating liquid having and inlet side an an outlet side;

means for generating recirculation of the fluid in the tank;

conveyor means for continuously conveying the objects from said inlet side to said outlet side of said tank in such a manner that the objects are fully dipped into the fluid;

said tank having a sloped bottom at said inlet side thereof and said conveyor means having substantially the same inclination as that of said sloped bottom of the tank; and gush-spraying nozzle means, arranged on said sloped bottom of the tank and connected to the recirculation means, for individually generating a flow of fluid to the bottom portions of the objects being conveyed, the direction of each flow being inclined rearwardly with respect to the vertical line in the direction of conveyance of the objects by the conveyor means at said inlet side of said tank.

According to another aspect of the present invention a method for phosphating objects, such as automobile bodies, having bottom portions of complicated configurations utilizing a tank having an inlet side, an outlet side, and a sloped bottom at said inlet side for holding a fluid of phosphating liquid is provided, which comprises:

recirculating the fluid in the tank;

continuously conveying the objects from said inlet side to said outlet side of the tank in such a manner that the objects are fully dipped into the tank; and gush-type spraying individual flows of fluid from said sloped bottom portion at the inlet side of said tank to the bottom portions of said objects being conveyed such that the directional flow of said fluid is inclined rearwardly with respect to a vertical line in the direction of conveyance of the object.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts throughout the several views and wherein.

DETAILED DESCRIPTION OF PREFERRED EMBODIMENTS

Figure 1:
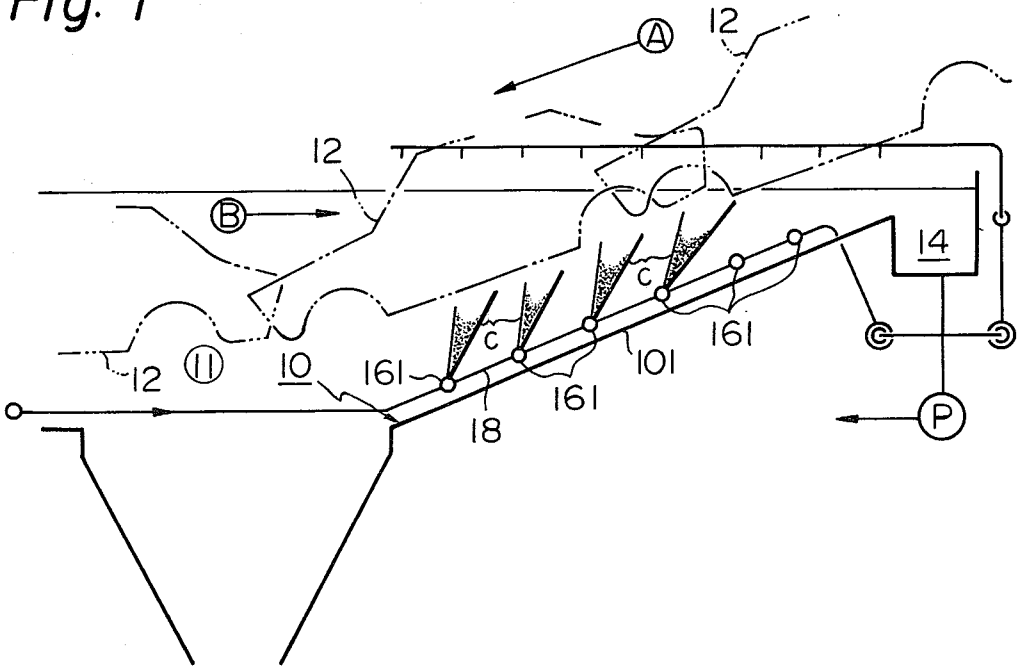
FIG. 1 is a schematic view of the system according to the present invention.

In FIG. 1, showing a system which phosphates objects, such as automobile bodies, according to the present invention, reference numeral 11 indicates a bath of a phosphating liquid. The objects 12 to be treated, held by a conveyor line (not shown), are introduced into the bath 10 so that they are fully dipped into the phosphating liquid. The container holding the bath 10 has, at its inlet side, a sloped bottom 101 having substantially the same inclination as that of the general plane of the bottom surface of the object 12. The phosphating liquid is charged into the bath 10. A flow of the liquid issued out from the bath is introduced into an overflow tank 14 located on one side of the main tank 10. The liquid in the over-flow tank 14 is recirculated into the main tank 10 by means of a pump P, so that a flow of working fluid, as shown by an arrow B, flowing in an opposite direction to the movement of the objects 12 to be treated, as shown by an arrow A, is generated in the treating tank 10.

Figure 2:
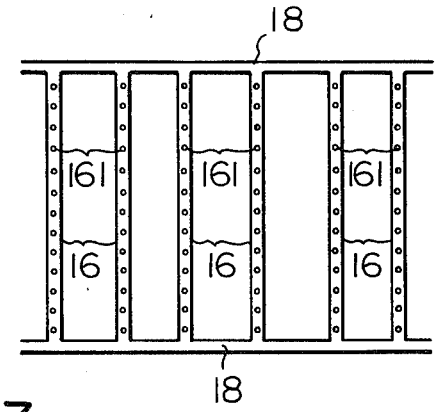
FIG. 2 is a plan view of the nozzle means in FIG. 1.

According to the present invention, gush-type spraying nozzle means are arranged on the sloped bottom 101 located on the inlet side of the tank 10 for discharging the flow of the fluid directed toward the bottom portion of the object 12 having a complicated configuration. The nozzle means comprises a plurality of nozzle pipes 16 (FIG. 2) which are parallel with each other and transverse to the movement of the objects 12. A pair of supply pipes 18 are connected to ends of each of the nozzle pipes 16. The supply pipes 18 are connected to a pump P to receive the flow of fluid therefrom. Each of the nozzle pipes 16 is provided with a plurality of gush-type spraying nozzles 161 for discharging the fluid in a flow pattern, as shown by an arrow C.

Figure 3:
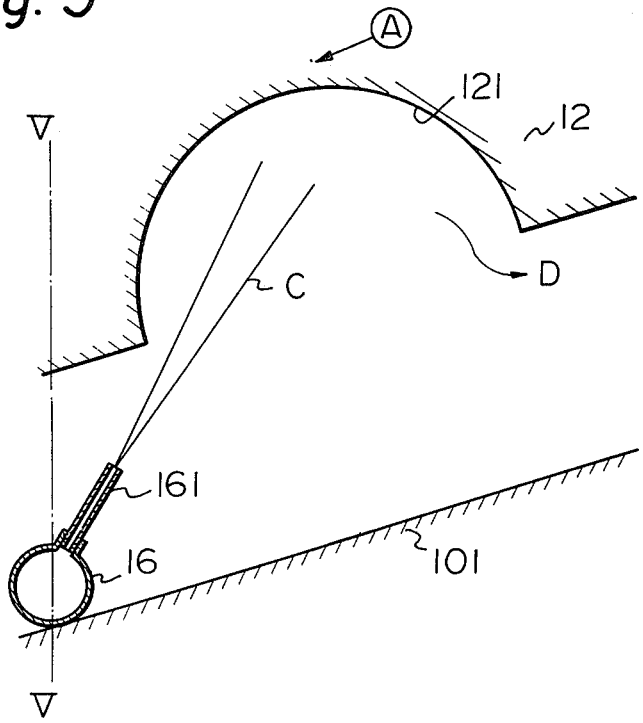
FIG. 3 is an enlarged view of FIG. 1 at the position of the sloped bottom of the tank.
Figure 4:
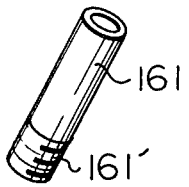
FIG. 4 shows the perspective view of a nozzle of a first embodiment.

As shown in FIGS. 3 and 4, each of the nozzles 161 forms a pipe piece of circular cross-section which has a screw thread 161' which is screw fitted to the main pipe 6. Each nozzle 161 is arranged such that the direction of the discharged flow pattern C is rearwardly inclined with respect to the vertical line V—V in the direction of the conveyance of the object to be treated and also inclined upwardly with respect to the surface of said sloped bottom of the tank.

During operation of the system according to the present invention, the objects 12 to be treated held by the conveyor (not shown) are introduced into the treating bath 10 so that the objects 12 are fully dipped into the phosphating liquid. A film-like layer of phosphating crystals are thus formed on the surface of the objects. As is well known to those skilled in this art, such a film provides resistance to corrosion of the objects 12 during use.

According to the present invention, ejection of the fluid from the nozzles 161 is toward the bottom surface of the objects 12. Since the direction of the ejection of the flow pattern C from the nozzles 161 located on the sloped bottom 101 of the tank is rearwardly inclined with respect to the vertical line V—V in the direction of the conveyance A, any air confined in recess portions 121 in the bottom surface of the body 12, which recess portions are arranged with an inclination corresponding to that of the sloped bottom 101, is effectively and forcibly exhausted in the direction shown by arrow D. Such an exhaust effect is readily attained since concentrated flow pattern C is generated from the nozzle 161 of a pipe shape as shown in FIG. 4. Due to the rapid exhaust of the air at the inlet region of the tank 10, uniform phosphating crystals can be formed on such objects. Thus, generation of "air pockets" is prevented.

The conveyor speed is selected so that one object 12 receives the discharge from the nozzles 161 for a time period of about 30 seconds. This is because the initial chemical reaction for generating nuclei of phosphating crystals forming occurs in such period between the 12 objects and the fluid.

Figure 5:
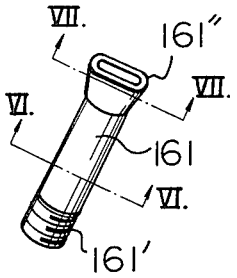
FIG. 5 shows a perspective view of a nozzle of the second embodiment.
Figure 6:
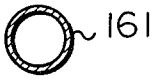
FIG. 6 shows a cross-sectional view taken along line VI—VI line in FIG. 5.
Figure 7:
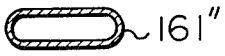
FIG. 7 shows a cross-sectional view taken along line VII—VII line in FIG. 5.

In another embodiment shown in FIGS. 5, 6 and 7, the nozzles 161 are formed by a pipe piece having an open end 161" which is flattened. Due to such construction of the nozzles, a strong flow of fluid reaches the entire portion of the recess 121.

While the present invention is described with reference to the attached drawings, many modifications and changes may be made by those skilled in this art.

What is claimed as new and desired to be secured by Letters Patent of the United States is:

1. A system for phosphating objects, such as automobile bodies, each having a bottom portion of complicated configuration, said system comprising:

a tank for holding a phosphating fluid and having an inlet side and an outlet side;

means for generating recirculation of the fluid in the tank;

conveyor means for continuously conveying the objects from said inlet side to said outlet side of said tank in such a manner that the objects are fully dipped into the fluid;

said tank having a sloped bottom at said inlet side thereof and said conveyor means having an inclination substantially the same as that of said sloped bottom of the tank; and gush-type spraying nozzle means, arranged on said sloped bottom of the tank and connected to the recirculation means, for generating a flow of fluid from said sloped bottom towards said bottom portions of the objects being conveyed, the direction of the flow being inclined rearwardly with respect to a vertical line in a direction of conveyance of the objects by the conveyor means at said inlet side of said tank and inclined upwardly with respect to the surface of said sloped bottom of the tank.

2. A system according to claim 2, wherein said gush-type spraying nozzle means further comprises a plurality of pipes arranged on said sloped bottom, wherein each of said pipes further comprises a purality of nozzle means facing the objects for producing said rearwardly inclined flow of fluid.

3. A system according to claim 2, wherein said plurality of pipes are parallel with each other and transverse to the said direction of movement of objects.

4. A system according to claim 2, wherein each of the nozzle means further comprises a pipe piece having one end connected to one of said pipes and a second outwardly opened end.

5. A system according to claim 4, wherein said second end is flattened.

6. A method for phosphating objects, such automobile bodies, each having bottom portions of complicated configuration and utilizing a tank having an inlet side, an outlet side, and a sloped bottom at said inlet side for holding a phosphating fluid, which comprises:

recirculating the fluid in the tank;

continuously conveying the objects from said inlet said to said outlet side of the tank in such a manner that the objects are fully dipped into the tank; and generating a gush-spray flow of fluid from said sloped bottom portion at the inlet side of said tank towards the bottom portions of said objects being conveyed such that a directional flow of said fluid is inclined rearwardly with respect to a vertical line in a direction of conveyance of the object and also inclined upwardly with respect to the surface of the sloped bottom of the tank.

* * * * *